US012514296B2

(12) United States Patent
Chen

(10) Patent No.: US 12,514,296 B2
(45) Date of Patent: Jan. 6, 2026

(54) ATOMIZING DEVICE WITH LIQUID INTAKE ADJUSTING MEMBER AND AEROSOL GENERATING DEVICE

(71) Applicant: Shenzhen Huachengda Precision Industry Co. Ltd., Guangdong (CN)

(72) Inventor: Ping Chen, Guangdong (CN)

(73) Assignee: Shenzhen Huachengda Precision Industry Co. Ltd., Shenzhen (CN)

( * ) Notice: Subject to any disclaimer, the term of this patent is extended or adjusted under 35 U.S.C. 154(b) by 384 days.

(21) Appl. No.: 18/015,955

(22) PCT Filed: Nov. 29, 2021

(86) PCT No.: PCT/CN2021/133935
§ 371 (c)(1),
(2) Date: Jan. 12, 2023

(87) PCT Pub. No.: WO2022/247187
PCT Pub. Date: Dec. 1, 2022

(65) Prior Publication Data

US 2023/0270170 A1 Aug. 31, 2023

(30) Foreign Application Priority Data

May 25, 2021 (CN) ..... 202110573841.1

(51) Int. Cl.
*A24F 40/48* (2020.01)
*A24F 40/10* (2020.01)
(Continued)

(52) U.S. Cl.
CPC ..... *A24F 40/485* (2020.01); *A24F 40/10* (2020.01); *A24F 40/40* (2020.01); *A24F 40/42* (2020.01);
(Continued)

(58) Field of Classification Search
CPC ..... A24F 40/10; A24F 40/40; A24F 40/42; A24F 40/46; A24F 40/48; A24F 40/485
See application file for complete search history.

(56) References Cited

U.S. PATENT DOCUMENTS

2019/0093783 A1 3/2019 Macko
2020/0068951 A1 3/2020 Li et al.

FOREIGN PATENT DOCUMENTS

CN 207969654 U 10/2018
CN 210929637 U 7/2020
(Continued)

OTHER PUBLICATIONS

Translation of CN 207969654 U (Year: 2017).*
(Continued)

*Primary Examiner* — Michael H. Wilson
*Assistant Examiner* — Michael Patrick Mullen

(57) ABSTRACT

An atomizing device and an aerosol generating device. The atomizing device comprises an oil storage bin, an atomizing mounting assembly, a heating atomizing assembly and a liquid intake adjusting member. The oil storage bin is internally provided with an air guide channel and an oil storage cavity used for storing an atomizable liquid. The heating atomizing assembly is mounted in the atomizing mounting assembly and is accommodated in the oil storage bin. A liquid guide channel is arranged between the heating atomizing assembly and the oil storage cavity. The liquid intake adjusting member is provided at a position in the liquid guide channel that is close to the heating atomizing assembly, is a thermosensitive metal sheet, and deforms upon sensing a change in the temperature of the heating atomizing assembly, so as to automatically adjust the magnitude of a liquid intake amount.

8 Claims, 16 Drawing Sheets

(51) Int. Cl.

| | |
|---|---|
| ***A24F 40/40*** | (2020.01) |
| ***A24F 40/42*** | (2020.01) |
| ***A24F 40/46*** | (2020.01) |
| ***A24F 40/485*** | (2020.01) |
| *A24F 40/50* | (2020.01) |
| *A24F 40/51* | (2020.01) |

(52) U.S. Cl.
CPC ..... *A24F 40/46* (2020.01); *A24F 40/48* (2020.01); *A24F 40/50* (2020.01); *A24F 40/51* (2020.01)

(56) References Cited

FOREIGN PATENT DOCUMENTS

| | | |
|---|---|---|
| CN | 112293797 A | 2/2021 |
| CN | 112293798 A | 2/2021 |

OTHER PUBLICATIONS

Translation of CN 210929637 U (Year: 2020).*
Translation of CN 112293798 A (Year: 2021).*
Extended European Search Report of Counterpart European Patent Application No. 21942750.7 issued on Jan. 16, 2024.
International Search Report of PCT Patent Application No. PCT/CN2021/133935 issued on Feb. 28, 2022.

* cited by examiner

ATOMIZING DEVICE WITH LIQUID INTAKE ADJUSTING MEMBER AND AEROSOL GENERATING DEVICE

FIELD

The present invention relates to the field of smoke products, and more specifically, to an atomizing device and an aerosol generating device.

BACKGROUND

The electric heating atomization technology is a novel atomization technology emerging in recent years, and is now widely used in medical, intelligent household appliances, and consumer electronics products. Its principle is to generate heat energy through the thermal effect of resistance, the heat energy then heats and atomizes a liquid into atomized steam.

Currently, the oil leakage problem of an atomizing device applied in the electronic cigarette industry has always existed. Because the electronic atomizing device atomizes and evaporates the liquid into steam through electric heating, while the liquid is stored in a liquid storage bin, and the liquid is communicated with the outside air through a porous medium.

In the current industry, generally other positions are sealed, and a porous liquid guide member is used as the only channel for communicating the liquid storage bin and the outside air. After the tiny micropores in the porous medium absorb the liquid, the air pressure difference between the liquid storage bin and the outside forms a negative pressure, so that the liquid can be stored in the liquid guide medium without leaking out of the atomizing device. However, there is a contradiction in the design of the atomizing device. If the micropores are small, the liquid conducting rate is slow, the formed negative pressure has a good oil locking performance, but it is easy to cause a poor liquid supply and the micropores blocked by atomized residues to form a carbon deposition and a core overburning. However, if the micropores are too large, the liquid conducting performance is good and the liquid supply is smooth, but it is easy to cause an oil leakage during use and transportation.

SUMMARY

A technical problem to be solved by the present invention is to provide an atomizing device and an aerosol generating device.

A technical solution adopted by the present invention to solve the technical problem is to provide an atomizing device, including an oil storage bin, an atomizing mounting assembly, a heating atomizing assembly, and a liquid intake adjusting member;

wherein the oil storage bin is internally provided with an air guide channel, and an oil storage cavity configured for storing an atomizable liquid, the heating atomizing assembly is disposed in the atomizing mounting assembly and accommodated in the oil storage bin, and a liquid guide channel is provided between the heating atomizing assembly and the oil storage cavity; and wherein the liquid intake adjusting member is disposed at a position in the liquid guide channel that is close to the heating atomizing assembly, and is a thermosensitive metal sheet, and configured to deform upon sensing a temperature change of the heating atomizing assembly, so as to automatically adjust the magnitude of a liquid intake amount.

Preferably, the liquid intake adjusting member is a sheet-shaped structure, and includes a fixing portion and a movable portion connected to the fixing portion, the fixing portion is clamped or fixed to the atomizing mounting assembly, and the movable portion is disposed in the liquid guide channel;

the heating atomizing assembly generates heat to deform the movable portion when working, thereby automatically adjusting the magnitude of the liquid intake amount.

Preferably, the movable portion includes a first surface and a second surface that are opposite each other;

a thermal expansion coefficient of the first surface of the movable portion is larger than a thermal expansion coefficient of the second surface of the movable portion, and the second surface of the movable portion is not shielded.

Preferably, the liquid intake adjusting member is a tubular structure, and includes a tubular body and an adjusting portion connected with the tubular body;

the tubular body is sleeved on the atomizing mounting assembly, and the adjusting portion extends out of the tubular body to shield the liquid guide channel;

the heating atomizing assembly generates heat to deform the adjusting portion when working, thereby automatically adjusting the magnitude of the liquid intake amount.

Preferably, the adjusting portion includes a first surface and a second surface that are opposite each other;

a thermal expansion coefficient of the first surface of the adjusting portion is larger than a thermal expansion coefficient of the second surface of the adjusting portion, the first surface of the adjusting portion is not shielded, and/or the second surface of the adjusting portion is not shielded.

Preferably, the atomizing mounting assembly includes a base, and a mounting seat arranged on the base and snap-engageable with the base, and the heating atomizing assembly is clamped between the mounting seat and the base;

the mounting seat includes a main body and an embedding portion extending downwards from the main body, the main body is provided with a liquid inlet groove communicating the oil storage cavity with the heating atomizing assembly, and the liquid intake adjusting member is clamped or fixed between a bottom of the liquid inlet groove and the heating atomizing assembly.

Preferably, the heating atomizing assembly includes a liquid guide member and a heating member, a surface of the liquid guide member facing the liquid guide channel is a liquid inlet surface, a surface of the liquid guide member opposite the liquid inlet surface is an atomizing surface, and an atomizing cavity is formed between the atomizing surface and the base, the heating member is arranged on the atomizing surface, the liquid intake adjusting member is arranged adjacent to the liquid inlet surface, or, the liquid intake adjusting member is arranged on an upper surface of the liquid inlet surface.

Preferably, the atomizing mounting assembly further includes a sealing sleeve that is sleeved on at least part of an outer periphery of the liquid guide member and disposed on an inner periphery of the embedding portion, a central portion of the sealing sleeve is provided with a through hole penetrating through an upper surface and a lower surface thereof, and the through hole and the liquid inlet groove cooperate to form the liquid guide channel, the fixing portion is clamped or fixed between the interior of the sealing sleeve and the liquid inlet surface.

Preferably, the atomizing mounting assembly further includes a sleeve sleeved on an outer periphery of the main body, the sleeve includes a top wall, and a pair of retaining walls that extend downwards from a periphery of the top wall and are arranged oppositely, and outer peripheries of the retaining walls abut against an inner wall of the oil storage bin, the top wall is provided with a liquid through hole penetrating through an upper surface and a lower surface thereof, and the liquid through hole is disposed corresponding to the liquid inlet groove.

Preferably, the base includes a bottom plate, the bottom plate extends upward to form an annular support portion, and the annular support portion extends upward to form support arms opposite to each other, the support arms are connected with the embedding portion in a snap-fit manner, outer peripheries of the support arms are connected with an inner wall of the oil storage bin in a snap-fit manner, and the bottom plate is further provided with a first conductive column electrically connected with the heating atomizing assembly, and an air inlet hole.

Preferably, the atomizing mounting assembly includes a foundation base, a rubber base arranged on the foundation base, and a mounting tube arranged on the rubber base, the heating atomizing assembly includes a liquid guide tube and a heating member, and the heating member includes a spiral heating portion arranged in the liquid guide tube and a conductive portion connected with the spiral heating portion, the liquid guide tube is arranged in the mounting tube, and the conductive portion extends out of the mounting tube and is mounted to a lower portion of the rubber base, the mounting tube is provided with a liquid inlet hole communicating the liquid guide tube with the oil storage cavity, and the liquid guide channel is formed between the liquid inlet hole and the oil storage cavity, the tubular body is sleeved on the mounting tube, and the adjusting portion extends out of the tubular body to shield the liquid inlet hole, and the heating atomizing assembly generates heat to deform the adjusting portion when working, thereby automatically adjusting the magnitude of the liquid intake amount of the liquid inlet hole.

Preferably, the atomizing mounting assembly further includes a sealing member that is columnar, the sealing member is provided with a through groove, a bottom portion of the air duct is mounted in the through groove, and the sealing member is further provided with a first clamping slot with an opening downward, the rubber base is provided with a positioning groove that is concave and provided with a second clamping slot therein, and an upper end of the mounting tube is clamped in the first clamping slot, and a lower end of the mounting tube is clamped in the second clamping slot.

Preferably, the positioning groove includes a first section and a second section which are communicated with each other, an inner diameter of the first section is larger than an inner diameter of the second section, a support step is formed at a connecting position between the first section and the second section, an upper end of the liquid guide tube abuts against a lower end of the sealing member, and a lower end of the liquid guide tube abuts against an upper surface of the support step, and the liquid inlet hole is located above the rubber base.

Preferably, the foundation base includes a bottom wall and an annular sidewall arranged on the bottom wall, and the annular sidewall is connected with an inner wall of the oil storage bin in a snap-fit manner.

Preferably, the bottom wall of the foundation base is further provided with a second conductive column electrically connected with the conductive portion, and the bottom wall of the foundation base is further provided with an air inlet through hole.

Preferably, a bottom portion of the rubber base is provided with a mounting hole, and one end of the conductive portion that is away from the spiral heating portion is bent into the mounting hole, and electrically connected with the second conductive column.

The present invention further provides an aerosol generating device, including the above-mentioned atomizing device and a power supply assembly configured to supply power to the atomizing device.

Implementation of the present invention provides the following beneficial effects: the atomizing device of the present invention includes the oil storage bin, the atomizing mounting assembly, the heating atomizing assembly, and the liquid intake adjusting member, the liquid guide channel is provided between the heating atomizing assembly and the oil storage cavity, the liquid intake adjusting member is disposed at the position in the liquid guide channel that is close to the heating atomizing assembly, and is a thermosensitive metal sheet, configured to deform upon sensing a temperature change of the heating atomizing assembly, so as to automatically adjust the magnitude of a liquid intake amount; by providing the liquid intake adjusting member, the volume of the atomizable liquid entering the heating atomizing assembly can be adjusted, thereby ensuring that the oil intake requirement of the heating atomizing assembly is met when working; meanwhile, in a non-working period or during a transportation process, the liquid intake adjusting member can control the liquid guide channel to be closed, such that a liquid leakage of the atomizing device can be prevented.

BRIEF DESCRIPTION OF THE DRAWINGS

Subject matter of the present invention will be described in even greater detail below based on the exemplary figures, and in the accompanying drawings.

DETAILED DESCRIPTION

Figure 1:
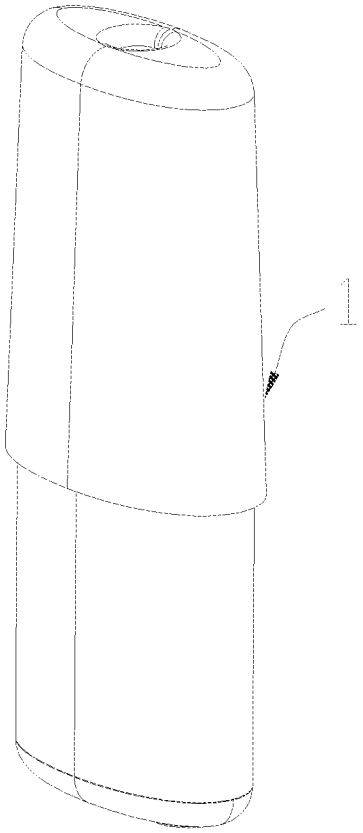
FIG. 1 is a structural diagram of an atomizing device in an embodiment of the present invention.

For better understanding of the technical features, objects and effects of the present invention, the specific embodiments of the present invention will be described in detail with reference to the accompanying drawings. In the description of the present invention, it should be understood that directions or location relationships indicated by terms "front", "rear", "upper", "lower", "left", "right", "longitudinal", "lateral", "vertical", "horizontal", "top", "bottom", "inner", "outer", "head", "tail" and the like are based on the directions or location relationships shown in the accompanying drawings, or the directions or location relationships that are usually placed or operated when the product is used, and are merely used for the convenience of describing the present invention, but are not used to indicate or imply that a device or an element needs to have a particular direction or be constructed and operated in a particular direction, and therefore, cannot be understood as a limitation to the present invention.

It should be further noted that, in the present invention, unless specified or limited otherwise, the terms "mounted", "communicated", "connected", "fixed", "arranged" and the like should be understood in a broad sense, for example, the connection may be a fixed connection, a detachable connection, or an integral connection; or the connection may be a mechanical connection, or an electrical connection; or the connection may be a direct connection, or an indirect connection through an intermediary; or the connection may be an internal communication between two elements or a mutual action relationship between two elements, unless otherwise specified explicitly. When one element is described to be located "above" or "under" another element, it means that the element may be "directly" or "indirectly" located above or under another element, or there may be one or more intervening element located therebetween. The terms "first", "second", "third" and the like are only used for the convenience of describing the technical solution, and cannot be understood as indicating or implying the relative importance or implicitly indicating the number of the indicated technical features. Therefore, features defined with "first", "second", "third", etc. may explicitly or implicitly indicates that one or more of these features may be included. For those of ordinary skill in the art, the specific meaning of the above-mentioned terms in the present invention can be understood according to specific circumstances.

First Embodiment

As shown in FIG. 1 to FIG. 13, an atomizing device of the invention includes an oil storage bin 1, an atomizing mounting assembly 2, a heating atomizing assembly 3, and a liquid intake adjusting member 4.

The oil storage bin 1 is provided therein with an air guide channel, and an oil storage cavity 11 configured for storing an atomizable liquid. The heating atomizing assembly 3 is disposed in the atomizing mounting assembly 2 and accommodated in the oil storage bin 1. A liquid guide channel is provided between the heating atomizing assembly 3 and the oil storage cavity 11.

The liquid intake adjusting member 4 is disposed at a position in the liquid guide channel close to the heating atomizing assembly 3. The liquid intake adjusting member 4 is a thermosensitive metal sheet, which senses the temperature change of the heating atomizing assembly 3 and produces deformation, so as to automatically adjust the liquid intake amount, and mainly to adjust the size of the liquid inlet space of the liquid guide channel to control the liquid intake amount.

In this embodiment, the oil storage bin 1 is made of a hard insulating material, such as phenolic plastic, polyurethane plastic, epoxy plastic, unsaturated polyester plastic, furan plastic, silicone resin, acrylic resin, or the like, and their modified resins. The oil storage bin 1 is generally an elongated structure extending in the direction of a central axis, that is, the length of the oil storage bin 1 along the central axis is far larger than the width and the thickness, in two perpendicular directions, in a cross section of the oil storage bin 1. The upper end of the oil storage bin 1 is provided with an air outlet 12, and the periphery of the air outlet 12 extends downward to form an air duct 13. The air outlet 12 and the air duct 13 cooperate to form the air guide channel. The lower end of the oil storage bin 1 is open, and the oil storage cavity 11 configured for storing the atomizable liquid is formed in the oil storage bin 1. The air duct 13 is made of a metal material, such as stainless steel or the like, and is a hollow circular duct structure. Of course, the air duct 13 may also be made of a high-molecular polymer with a good stability, and the material, shape and size of the air duct 13 may be selected and designed according to requirements, which are not specifically limited herein.

Figure 2:
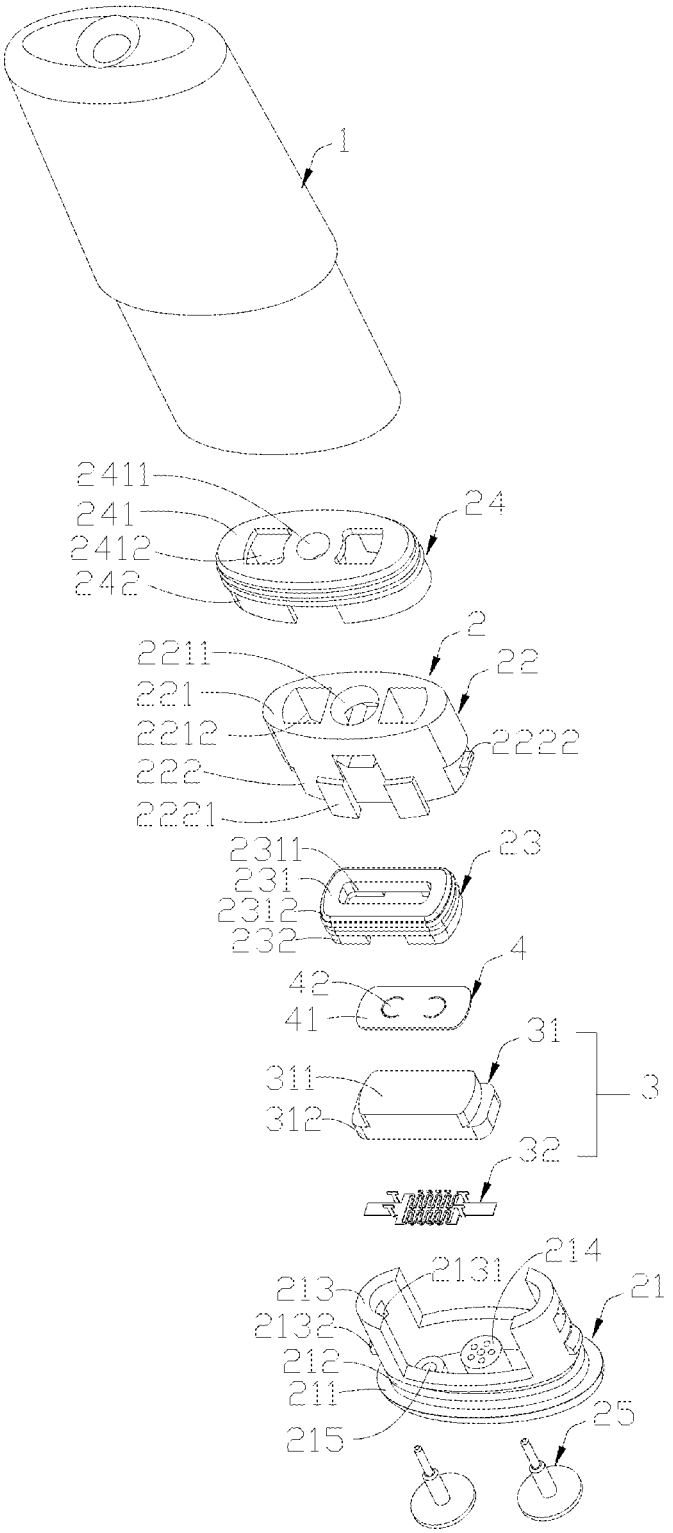
FIG. 2 is an exploded view of the atomizing device in FIG. 1 (wherein the liquid guide channel is closed by the liquid intake adjusting member)
Figure 3:
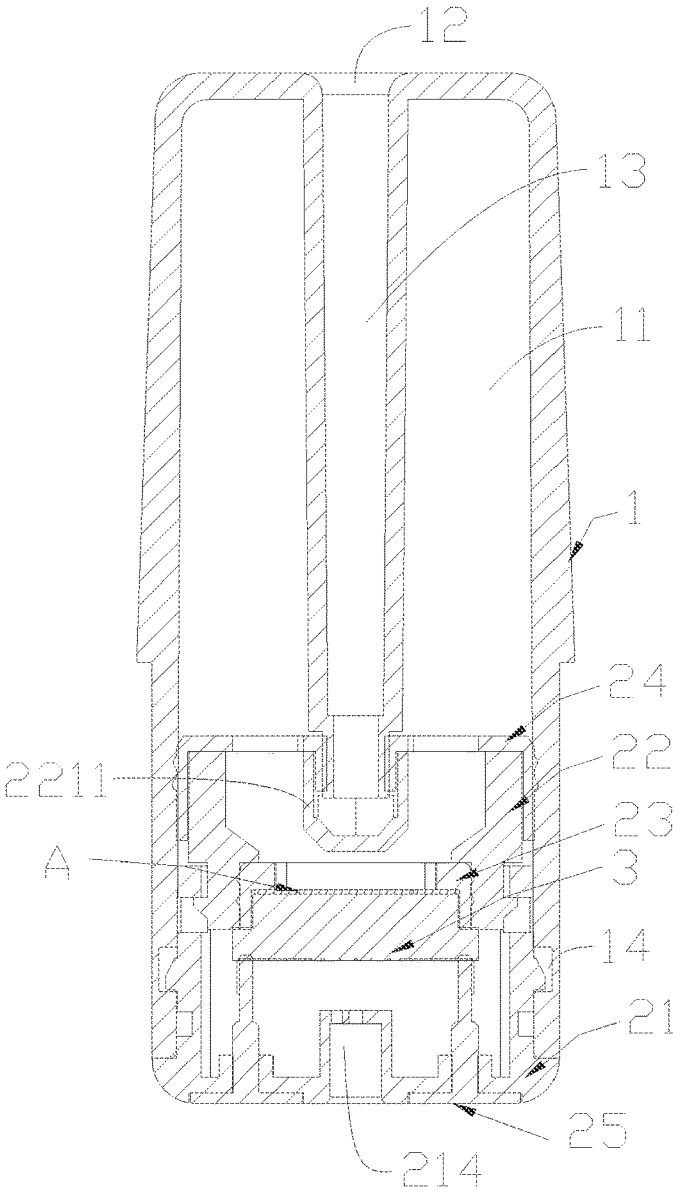
FIG. 3 is a sectional view of the atomizing device in FIG. 1.
Figure 4:
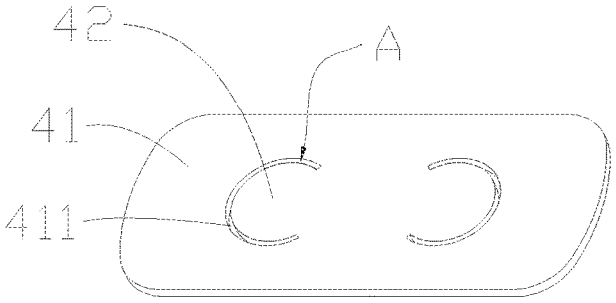
FIG. 4 is a schematic diagram of a liquid intake adjusting member (in a closed state) of the present invention.
Figure 5:
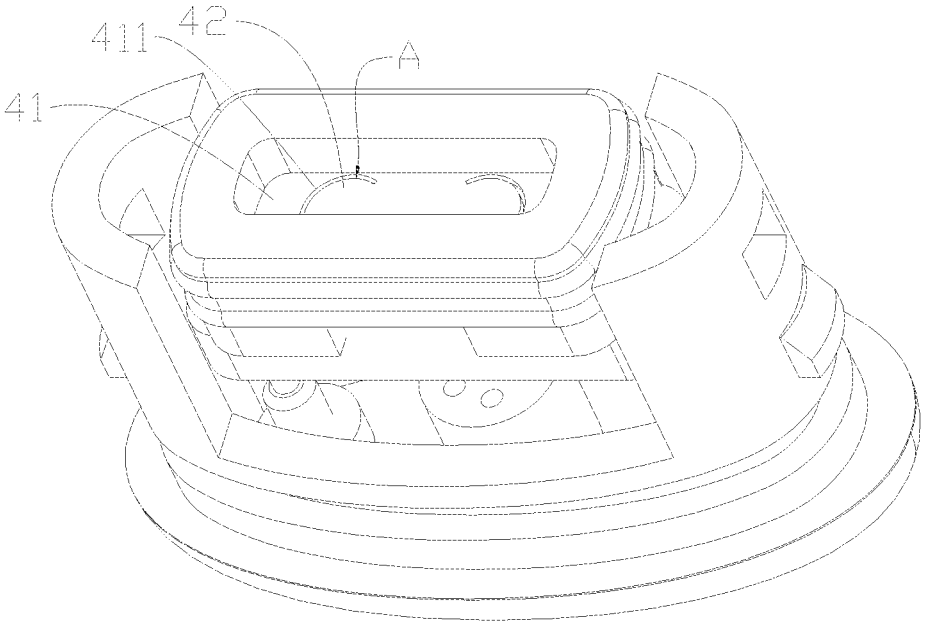
FIG. 5 is a schematic diagram showing the liquid intake adjusting member in FIG. 4 placed in an atomizing mounting assembly.
Figure 6:
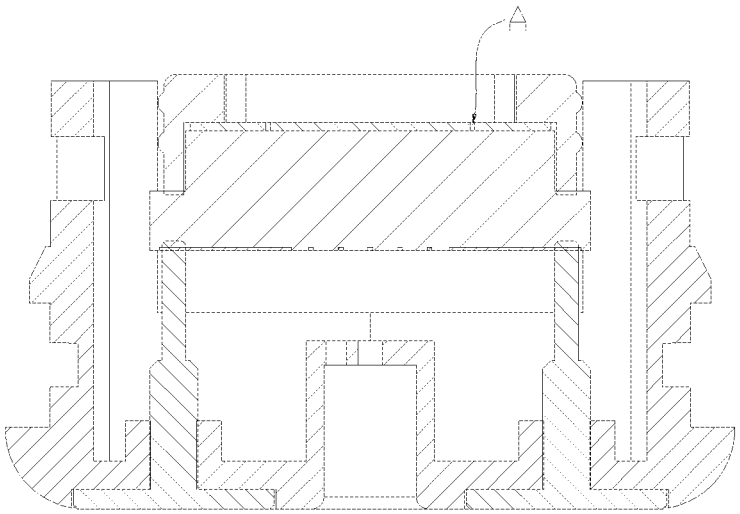
FIG. 6 is a sectional view of FIG. 5.
Figure 7:
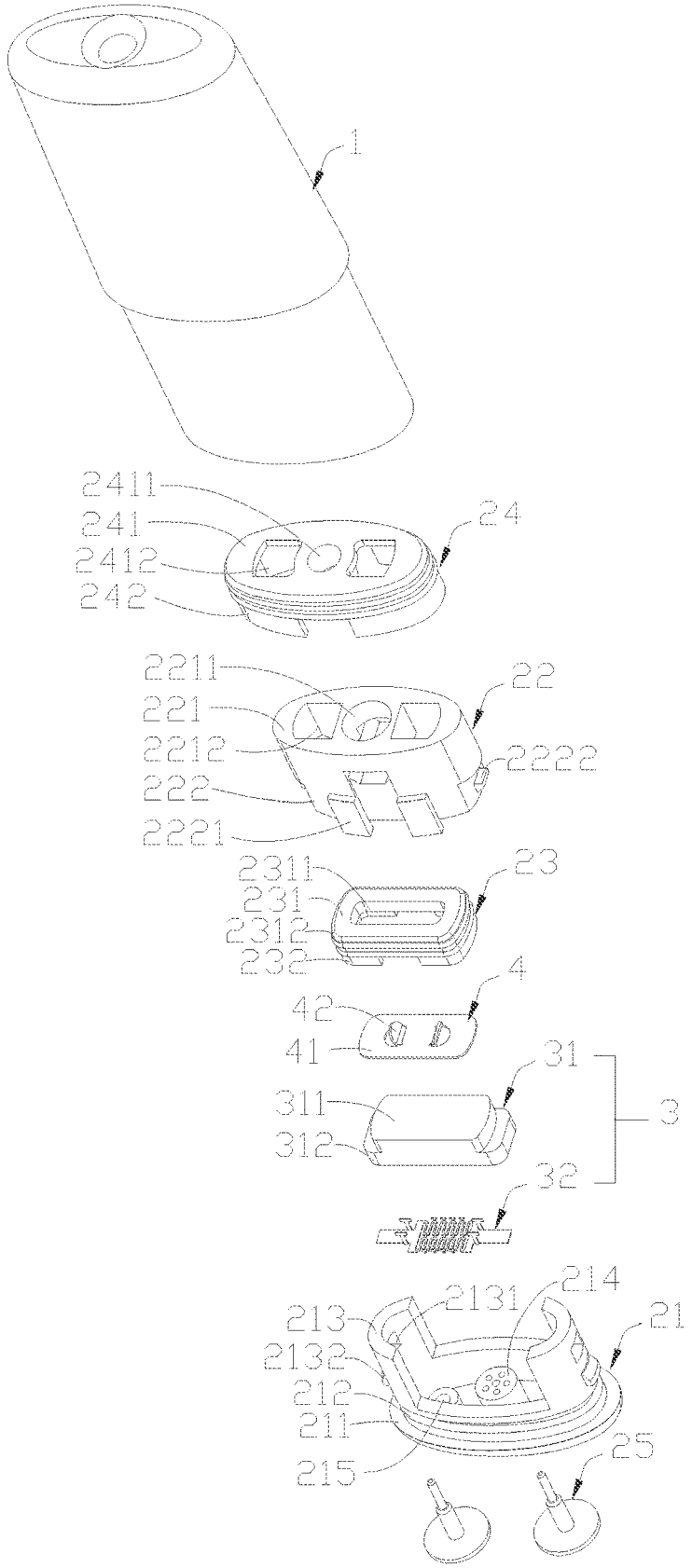
FIG. 7 is an exploded view of the atomizing device in FIG. 1 (wherein the liquid guide channel is opened by the liquid intake adjusting member)
Figure 8:
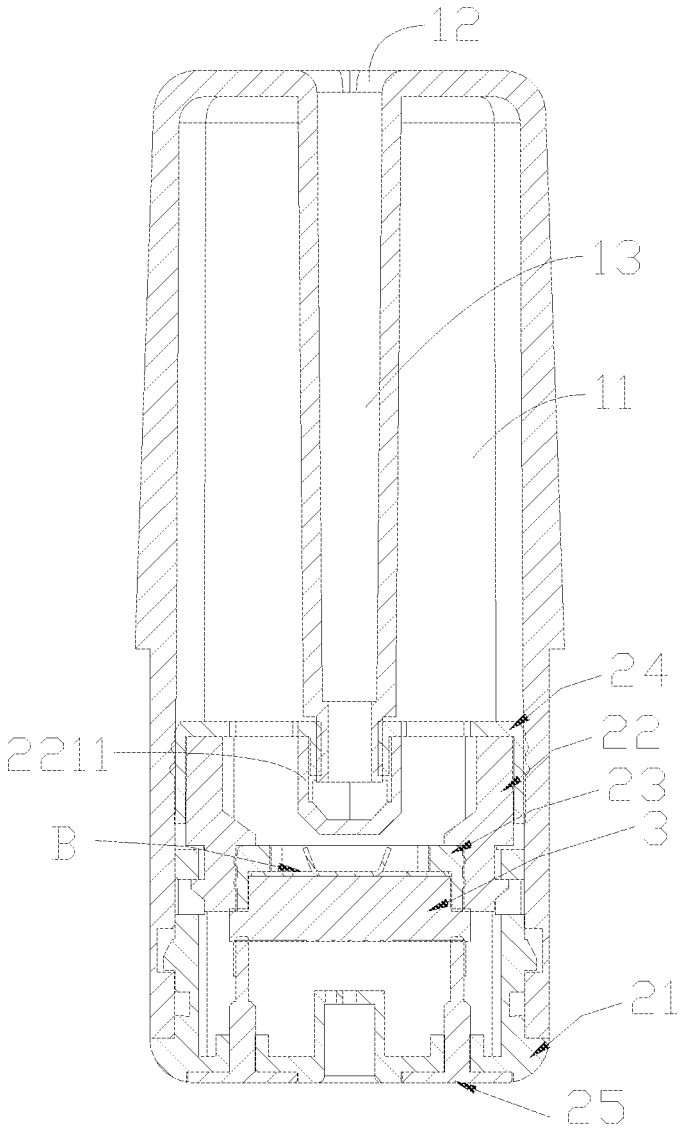
FIG. 8 is a sectional view of the atomizing device in FIG. 7.
Figure 9:
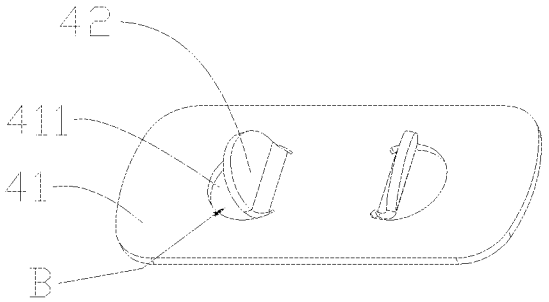
FIG. 9 is a schematic diagram of a liquid intake adjusting member (in an open state) of the present invention.
Figure 10:
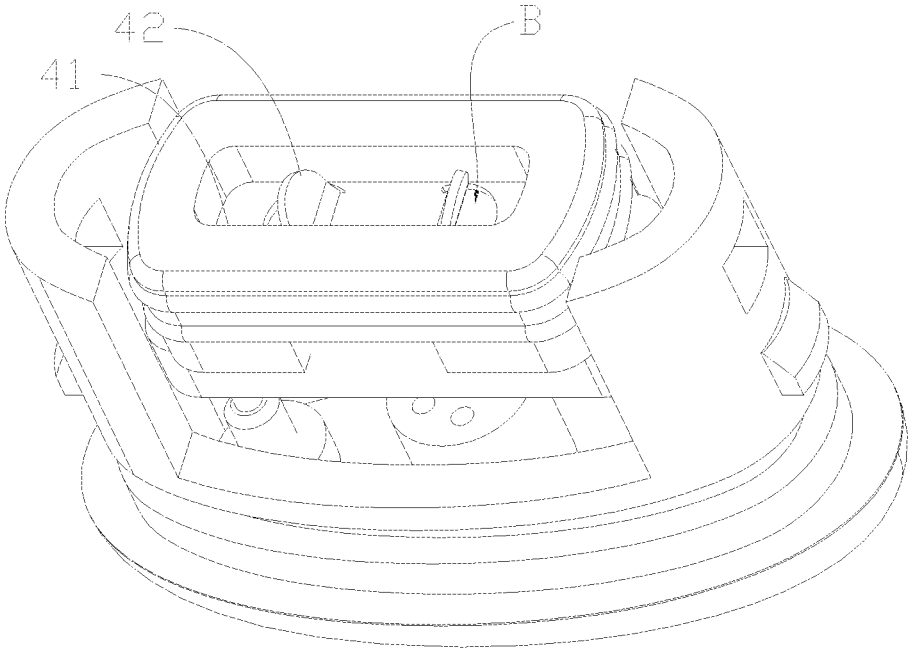
FIG. 10 is a schematic diagram showing the liquid intake adjusting member in FIG. 9 placed in an atomizing mounting assembly.
Figure 11:
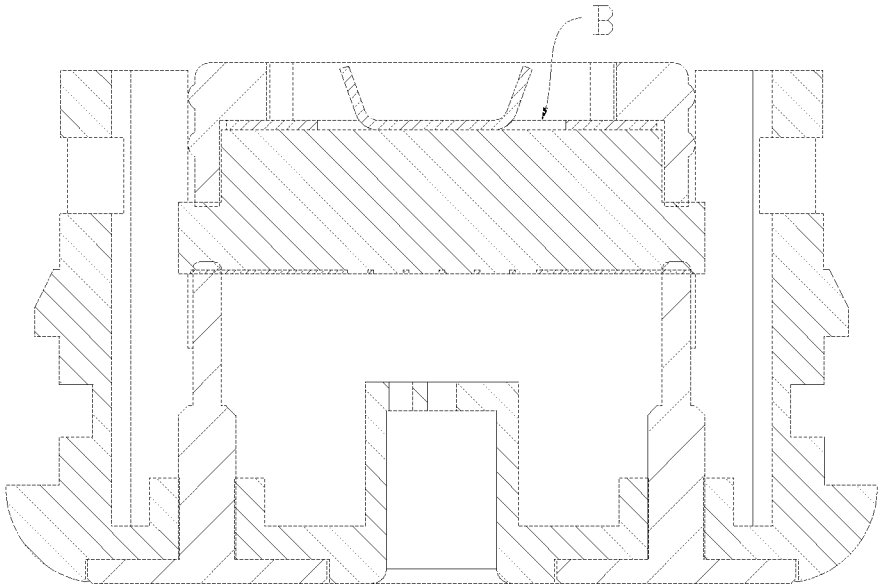
FIG. 11 is a sectional view of FIG. 10.

As shown in FIG. 2 to FIG. 3, preferably, the atomizing mounting assembly 2 includes a base 21, and a mounting seat 22 arranged on the base 21 and snap-engageable with the base 21. The heating atomizing assembly 3 is clamped between the mounting seat 22 and the base 21.

Further, the mounting seat 22 includes a main body 221 and an embedding portion 222 extending downwards from the main body 221. The main body 221 is provided with a liquid inlet groove 2212 communicating the oil storage cavity 11 with the heating atomizing assembly 3. The liquid intake adjusting member 4 is arranged between the bottom of the liquid inlet groove 2212 and the heating atomizing assembly 3.

Preferably, the heating atomizing assembly 3 includes a liquid guide member 31 and a heating member 32. The surface of the liquid guide member 31 facing the liquid guide channel is a liquid inlet surface, and the surface opposite the liquid inlet surface is an atomizing surface. An atomizing cavity is formed between the atomizing surface and the base 21. The heating member 32 is arranged on the atomizing surface. The liquid intake adjusting member 4 is arranged adjacent to the liquid inlet surface, or, the liquid intake adjusting member 4 is arranged on the upper surface of the liquid inlet surface.

The liquid guide member 31 is made of porous ceramic. It may be understood that the liquid guide member 31 may also be made of a porous material having a microporous capillary effect, such as a foamed metal, a porous glass, a hard glass fiber tube, or the like.

The heating member 32 may be made of a material having an appropriate impedance, such as a metal material, a metal alloy, a graphite, a carbon, a conductive ceramic or a composite material of other ceramic material and a metal material. The metal or alloy materials having an appropriate impedance include at least one of nickel, cobalt, zirconium, titanium, nickel alloy, cobalt alloy, zirconium alloy, titanium alloy, nickel chromium alloy, nickel iron alloy, iron chromium alloy, iron chromium aluminum alloy, iron manganese aluminum base alloy or stainless steel.

Preferably, the heating member 32 includes a first conductive portion, a second conductive portion, a first heating portion and a second heating portion. The first heating portion and the second heating portion are curved runway structures, and the positions, adjacent to each other, of the first heating portion and the second heating portion are connected through a connecting structure to form a parallel structure. The first ends of the first heating portion and the second heating portion are connected with the first conductive portion, and the first conductive portion is arranged on the left side of the first heating portion and the second heating portion. The second ends of the first heating portion and the second heating portion are connected with the second conductive portion, and the second conductive portion is arranged on the right side of the first heating portion and the second heating portion.

Preferably, the heating member 32 further includes a first hook claw connected with the first conductive portion and a second hook claw connected with the second conductive portion. The first hook claw and the second hook claw are fitted in the liquid guide member 31, and may be L-shaped structures, to improve the fixing stability of the heating member 32. It may be understood that the heating member 32 may be integrated with the liquid guide member 31, or may be printed on the liquid guide member 31 by using a printing process. Of course, the first heating portion and the second heating portion may also be provided with hook claws, and the structures of the hook claws may be various, which are not specifically limited herein.

Of course, the heating member 32 may be a sheet-shaped heating mesh, and the heating member 32 is attached and fixed to the atomizing surface of the liquid guide member 31. The heating member 32 may be in a discal shape bent by a heating wire or may be a grid-shaped heating sheet, and the heating member 32 may be sintered with the liquid guide member 31 into an integral structure to be attached to the atomizing surface. In some embodiments, the heating member 32 may also be a heating circuit, a heating track, a heating coating or a heating film formed on the bottom surface (atomizing surface) of the liquid guide member 31. The structure and the shape of the heating member 32 may be varied and may be selected according to the requirements. The heating mesh, the heating wire, the heating sheet, the heating circuit, the heating track, the heating coating or the heating film is disposed corresponding to the atomizing surface, so that the atomizing surface is closest to the heating member 32, the atomizable liquid, such as the e-liquid, can quickly reach the heating track for atomization.

Furthermore, the atomizing mounting assembly 2 further includes a sealing sleeve 23, which is sleeved on at least part of the outer periphery of the liquid guide member 31 and disposed on the inner periphery of the embedding portion 222.

The central portion of the sealing sleeve 23 is provided with a through hole 2311 that runs through its upper surface and lower surfaces, and the through hole 2311 and the liquid inlet groove 2212 cooperate to form the liquid guide channel. Preferably, the sealing sleeve 23 may include an annular portion 231, the hollow structure of the annular portion 231 forms the through hole 2311. The outer periphery of the annular portion 231 may further be provided with an annular protruding structure 2312, and the protruding structure 2312 abuts against the inner periphery of the embedding portion 222. The periphery of the annular portion 231 extends downward to form a surrounding portion 232, and the surrounding portion 232 surrounds the outer periphery of the upper portion of the liquid guide member 31. The sealing sleeve 23 may be a silicone sleeve.

Preferably, the liquid guide member 31 includes a first portion 311 and a second portion 312. The first portion 311 is located at the upper portion of the second portion 312, and the length of the first portion 311 is less than the length of the second portion 312, to be roughly in a stepped structure. The surrounding portion 232 surrounds the first portion 311, and the lower side surface of the surrounding portion 232 abuts against the upper surface of the portion of the second portion 312 that protrudes from the first portion 311 in the length direction. The liquid intake adjusting member 4 is arranged between the inside of the sealing sleeve 23 and the liquid inlet surface, or, the liquid intake adjusting member 4 is arranged inside the sealing sleeve 23 and is located on the upper surface of the liquid inlet surface.

Preferably, the atomizing mounting assembly 2 further includes a sleeve 24 sleeved on the outer periphery of the main body. The sleeve 24 includes a top wall 241, and a pair of retaining walls 242 extending downward from the periphery of the top wall 241 and arranged oppositely. The outer periphery of the retaining wall 242 abuts against the inner wall of the oil storage bin 1. The top wall 241 is provided with a liquid through hole 2412 running through its upper and lower surfaces, and the liquid through hole 2412 is disposed corresponding to the liquid inlet groove 2212. In this embodiment, two liquid through holes 2412 and two liquid inlet grooves 2212 may be provided. Furthermore, the outer periphery of the top wall 241 is provided with an annular protrusion which abuts against the inner wall of the oil storage bin 1. The sleeve 24 may be made of silica gel.

Preferably, the top wall 241 is provided with a connecting cylinder 2411, the lower end of the air duct 13 is mounted in the connecting cylinder 2411. Further, the main body 221 is provided with a concave air guide groove 2211, the connecting cylinder 2411 is accommodated in the air guide groove 2211, and the two opposite sides of the air guide groove 2211 are provided with air guide holes, Preferably, the air guide groove 2211 is roughly in a U-shaped structure, and the opposite wall surface of the air guide groove 2211 is the wall surface of the liquid inlet groove 2212. Preferably, the outer periphery of the embedding portion 222 is provided with flow deflecting bumps 2221 on two sides of the air guide hole for deflecting the air flow.

The atomizable liquid is heated and atomized to generate aerosol, and then the aerosol enters the air guide groove 2211 from the air guide hole, and then enters the air duct 13 from the air guide groove 2211.

In this embodiment, the base 21 includes a bottom plate 211, the bottom plate 211 extends upward to form an annular support portion 212, and the annular support portion 212 extends upward to form a pair of support arms 213 opposite to each other. The support arm 213 is connected with the embedding portion 222 in a snap-fit manner. Preferably, each support arm 213 is provided with a limiting slot 2131, and an outer side of the embedding portion 222 is provided with a first hook 2222, and the first hook 2222 is snapped into the limiting slot 2131, to fix the mounting mount 22 to the base 21.

Furthermore, the outer periphery of the support arm 213 is connected with the inner wall of the oil storage bin 1 in a snap-fit manner. The outer periphery of the support arm 213 is provided with a second hook 2132, the inner wall of the oil storage bin 1 close to the opening is provided with a slot 14, and the second hook 2132 is snapped into the slot 14 to fix the base 21 into the oil storage bin 1. The bottom plate 211 is further provided with two first conductive columns 25 electrically connected with the heating atomizing assembly 3. The bottom plate 211 is provided with a limiting tube 215, and the first conductive column 25 passes through the limiting tube 215 to be electrically connected with the heating atomizing assembly 3.

The bottom plate 211 is further provided with an air inlet hole. Preferably, the bottom plate 211 is provided with an air guide cylinder 214, the upper portion of the air guide cylinder 214 is provided with a plate body, and the plate body is provided with the air inlet hole. A plurality of air inlet holes may be provided, and the number of the air inlet holes may be selected according to requirements, which is not specifically limited herein.

In this embodiment, the liquid intake adjusting member 4 is a sheet-shaped structure, and includes a fixing portion and a movable portion connected to the fixing portion. The fixing portion is clamped or fixed to the atomizing mounting assembly 2, and the movable portion is disposed in the liquid guide channel. The heating atomizing assembly 3 generates heat to deform the movable portion when it is working, thereby automatically adjusting the liquid inlet amount.

The movable portion includes a first surface and a second surface that are opposite each other. The thermal expansion coefficient of the first surface of the movable portion is larger than the thermal expansion coefficient of the second surface of the movable portion. There is no shelter above the second surface of the movable portion, that is, there is a movable space above the second surface of the movable portion, so as to facilitate the deformation of the movable portion to adjust the liquid inlet amount.

As shown in FIG. 4 to FIG. 6 and FIG. 9 to FIG. 11, specifically, the liquid intake adjusting member 4 may include a first fixing portion 41 and a first movable portion 42. The first fixing portion 41 is roughly a rectangular plate structure, and is provided with a mounting groove 411 running through its upper and lower surfaces. The first end of the first movable portion 42 is connected to the circumferential inner wall of the mounting groove 411, and a predetermined gap is reserved between the circumferential side surface of the first movable portion 42 (except the first end) and the circumferential inner wall of the mounting groove 411, or the circumferential side surface of the first movable portion 42 (except the first end) is attached to the circumferential inner wall of the mounting groove 411.

Furthermore, two first movable portions 42 may be provided symmetrically. The deformation directions of the two first movable portions 42 are the same or opposite. For example, the two first movable portions 42 are deformed clockwise or counterclockwise, or one is deformed clockwise, and the other is deformed counterclockwise.

In the working state of the heating atomizing assembly 3, the first movable portion 42 is heated and deforms to the side away from the liquid guide member 31, which increases the liquid inlet space of the mounting groove 411 and thus increases the amount of the atomizable liquid entering the liquid guide member 31.

It may be understood that the liquid inlet space of the mounting groove 411 is A in a room temperature (the heating atomizing assembly 3 does not work), and the liquid inlet space of the mounting groove 411 gradually becomes to B in the working state of heating the atomization assembly 3, that is, the liquid inlet area of the atomizable liquid is increased, and thus the amount of the atomizable liquid entering the liquid guide member 31 for heating and atomizing is increased.

Figure 12:
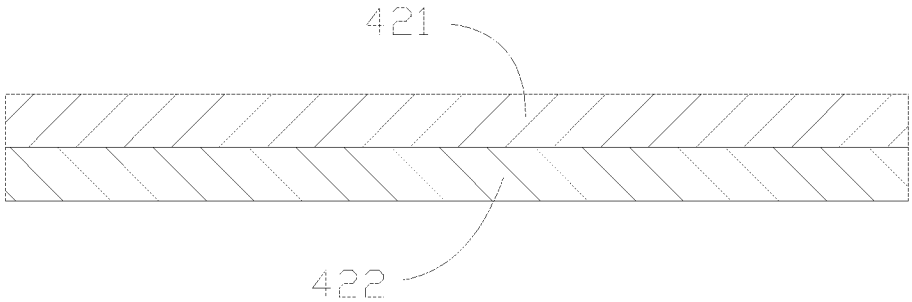
FIG. 12 is a structural diagram of a first movable portion in an embodiment of the present invention.
Figure 13:
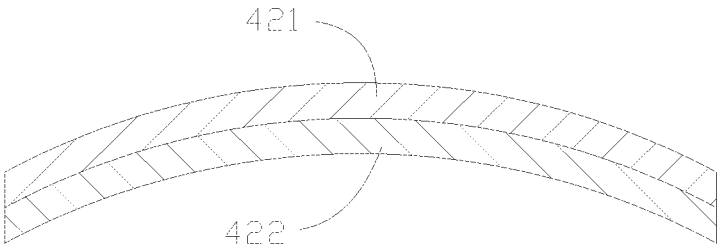
FIG. 13 is a structural diagram of the first movable portion in FIG. 12 deformed by heat.
Figure 14:
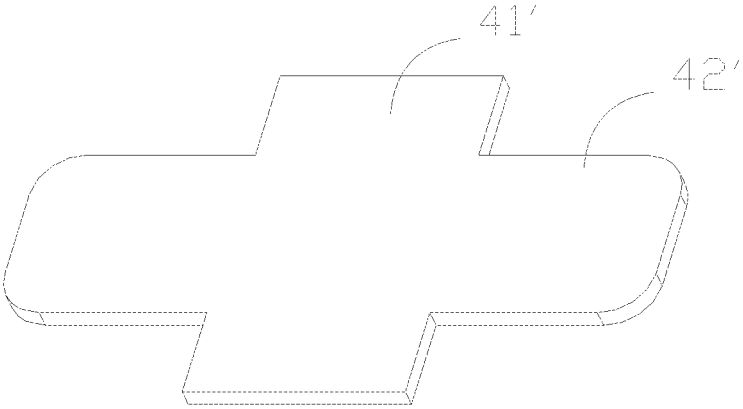
FIG. 14 is a structural diagram of a liquid intake adjusting member (in a closed state) in another embodiment of the present invention.
Figure 15:
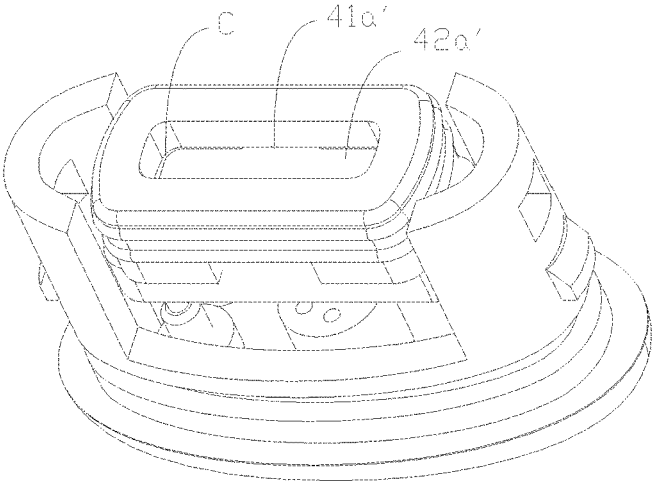
FIG. 15 is a structural diagram showing the liquid intake adjusting member in FIG. 14 placed in an atomizing mounting assembly.
Figure 16:
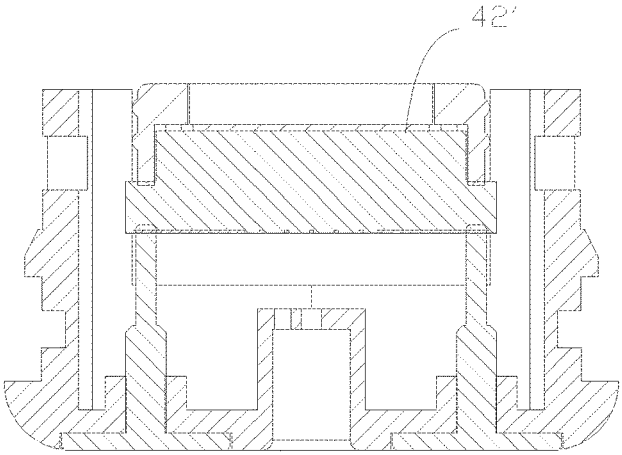
FIG. 16 is a sectional view of FIG. 15.
Figure 17:
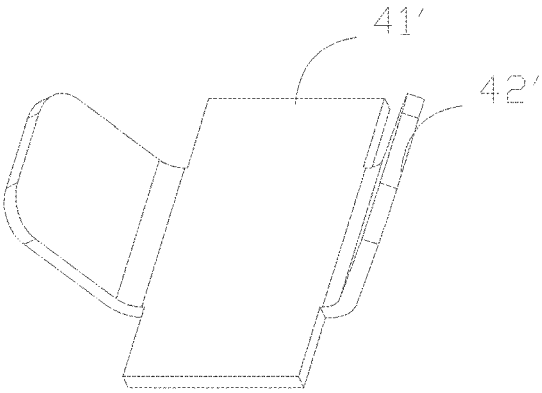
FIG. 17 is a structural diagram of the liquid intake adjusting member (in an open state) in FIG. 14.
Figure 18:
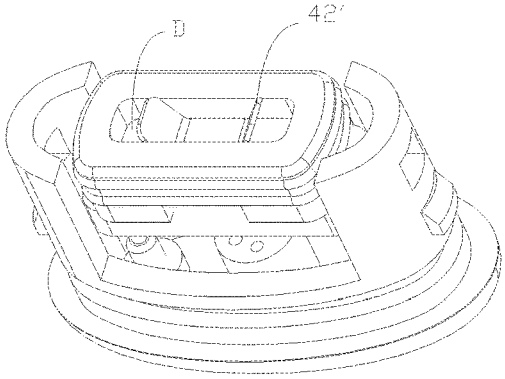
FIG. 18 is a structural diagram showing the liquid intake adjusting member in FIG. 17 placed in an atomizing mounting assembly.
Figure 19:
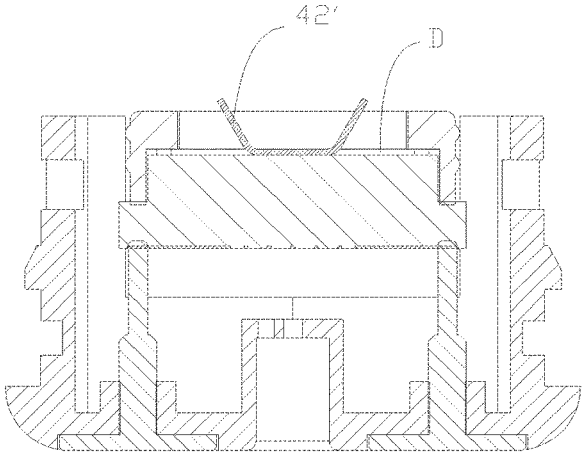
FIG. 19 is a sectional view of FIG. 18.
Figure 20:
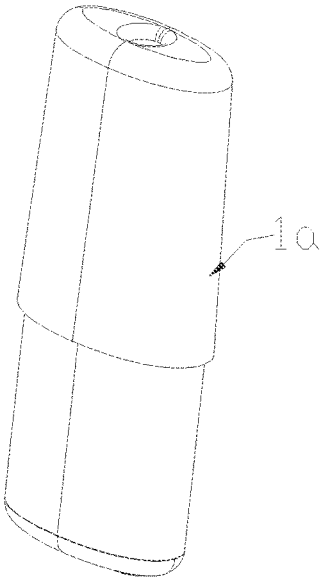
FIG. 20 is a structural diagram of an atomizing device in another embodiment of the present invention.
Figure 21:
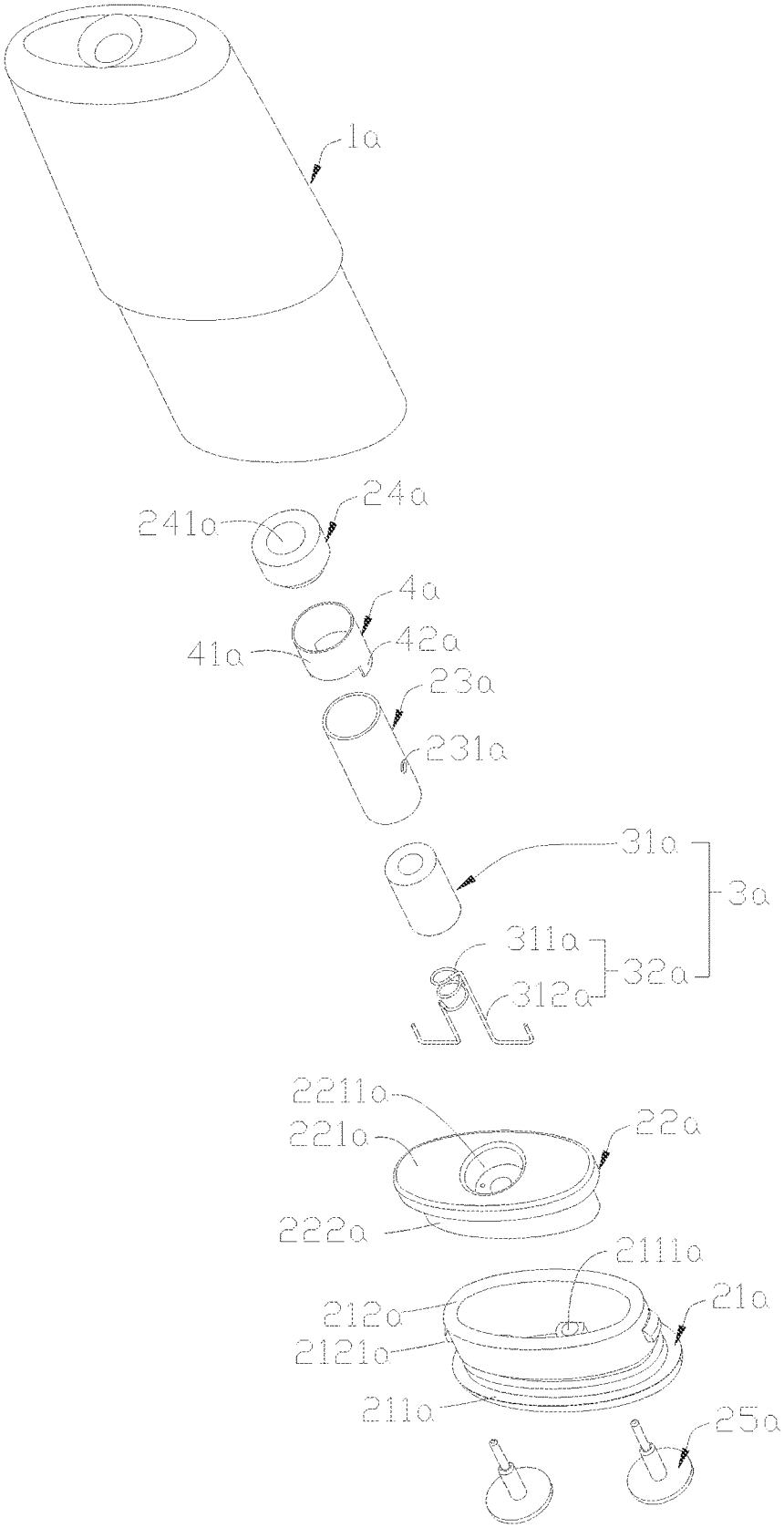
FIG. 21 is an exploded view of the atomizing device (wherein the liquid intake adjusting member is in a closed state) in FIG. 20.
Figure 22:
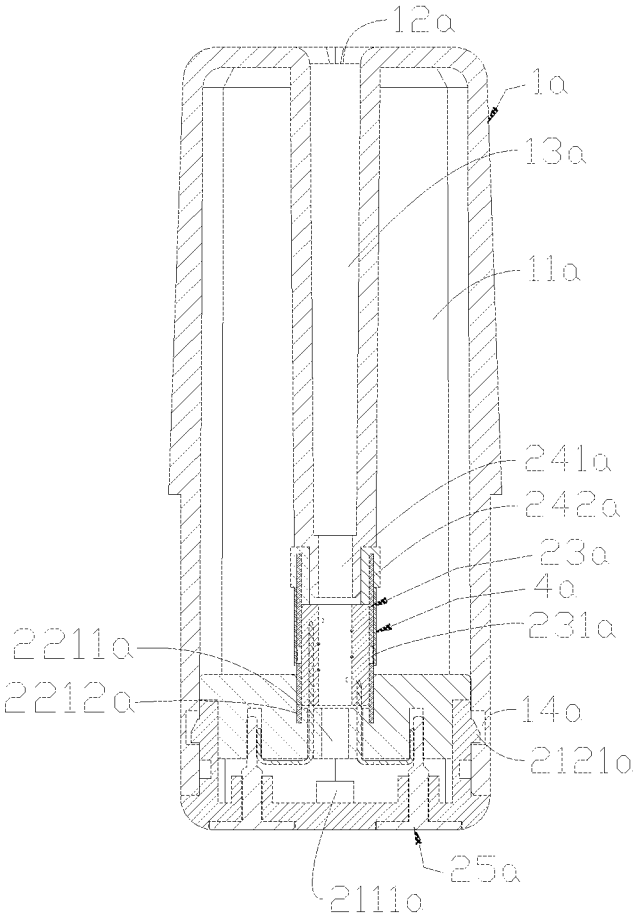
FIG. 22 is a sectional view of the atomizing device in FIG. 20.
Figure 23:
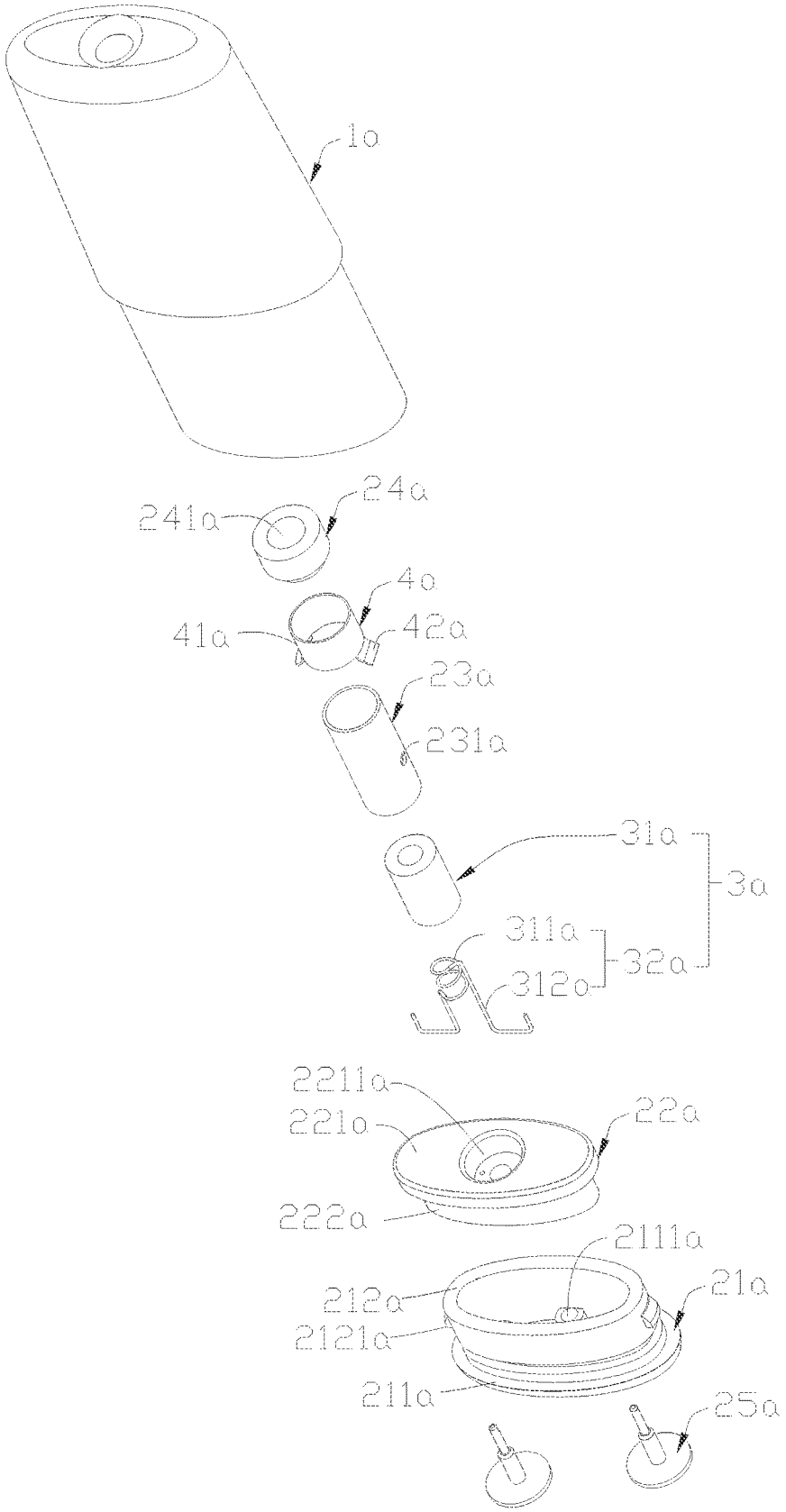
FIG. 23 is an exploded view of the atomizing device (wherein the liquid intake adjusting member is in an open state) in FIG. 20.
Figure 24:
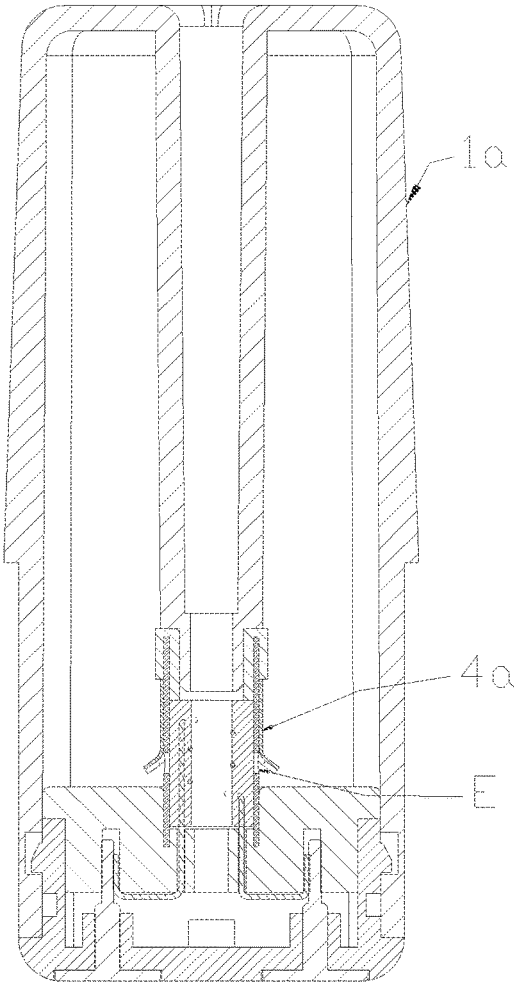
FIG. 24 is a sectional view of the atomizing device (wherein the liquid intake adjusting member is in the open state) in FIG. 20.

As an example, as shown in FIG. 12 to FIG. 13, the first movable portion 42 is a thermosensitive metal sheet, and the thermosensitive metal sheet is a composite member composed of two or more metals or other materials having appropriate properties. Wherein, the one with a relatively high thermal expansion coefficient is referred to as an active layer, and the one with a relatively low thermal expansion coefficient is referred to as a passive layer. The active layer is mainly made of manganese nickel copper alloy, nickel chromium iron alloy, nickel manganese iron alloy, nickel, or the like. The passive layer is mainly made of nickel iron alloy, and the nickel content is generally 34% to 50%. Due to the difference in the thermal expansion coefficients of the metals, when the temperature changes, the deformation of the active layer is larger than that of the passive layer, so that the thermosensitive metal sheet will be bent and deformed.

In this embodiment, the first movable portion 42 may include a first thermosensitive metal layer 421 and a second thermosensitive metal layer 422. The lower surface of the first thermosensitive metal layer 421 is attached to the upper surface of the second thermosensitive metal layer 422. The thermal expansion coefficient of the first thermosensitive metal layer 421 is less than the thermal expansion coefficient of the second thermosensitive metal layer 422, that is, the first thermosensitive metal layer 421 is the passive layer, and the second thermosensitive metal layer 422 is the active layer. The second thermosensitive metal layer 422 is arranged facing (toward) the liquid guide member 31, and the first thermosensitive metal layer 421 is arranged facing away from the liquid guide member 31. There is no shelter above the upper surface of the first thermosensitive metal layer 421, and a movable space for the deformation of the first movable portion 42 is reserved above the upper surface of the first thermosensitive metal layer 421.

Of course, the first movable portion 42 may also include a plurality of thermosensitive metal layers, and the thermal expansion coefficients of the plurality of thermosensitive metal layers gradually increase in the direction away from the liquid guide member 31.

The first fixing portion 41 may be made of a thermosensitive metal layer, or may be made of a silicone material or other material, which is not specifically limited herein. Understandably, the liquid intake adjusting member 4 may be an integrated structure or a combined structure.

It may be understood that when the heating atomizing assembly 3 of the atomizing device works and generates heat, the heat is transmitted to the thermosensitive metal layers (such as the first thermosensitive metal layer 421 and the second thermosensitive metal layer 422), and the thermosensitive metal layers are deformed due to different thermal expansion coefficients, thereby opening or enlarging the liquid inlet area (for example, the liquid inlet space is increased from A to B), so that the atomizable liquid entering the liquid guide member 31 is sufficient to meet the liquid consumption during atomization. When the atomizing device stops working, the heating atomizing assembly 3 will slowly return to the room temperature, and the thermosensitive metal layers will return to the original shape, thus closing or reducing the liquid inlet area (for example, the liquid inlet space is decreased from B to A), so that no atomizable liquid or very little atomizable liquid reaches the heating atomizing assembly 3, to effectively prevent the liquid from leaking out of the atomizing device.

Second Embodiment

As shown in FIG. 14 to FIG. 19, the difference between this embodiment and the first embodiment lies in the structure of the liquid intake adjusting member. The liquid intake adjusting member 4' in this embodiment includes a plate-shaped (sheet-shaped) second fixing portion 41' and a second movable portion 42' connected to at least one side of the second fixing portion 41'. The second fixing portion 41' is in a rectangular plate structure, one side or two sides of the second fixing portion 41' are provided with the second movable portion 42'.

When the heating atomizing assembly 3 is not working, the second fixing portion 41' and the second movable portion 42' separate the liquid guide member 31 from the liquid guide channel. When the heating atomizing assembly 3 is working, the second movable portion 42' is heated and deformed away from the liquid guide member 31, so that the liquid guide space communicating the liquid guide member 31 and the liquid guide channel increases (the liquid guide space C gradually increases to the liquid guide space D), and the atomizable liquid entering the liquid guide member 31 increases.

Further, the second movable portion 42' may include a third thermosensitive metal layer and a fourth thermosensitive metal layer, the lower surface of the third thermosensitive metal layer is attached to the upper surface of the fourth thermosensitive metal layer, and the thermal expansion coefficient of the third thermosensitive metal layer is less than the thermal expansion coefficient of the fourth thermosensitive metal layer. There is no shielding above the upper surface of the third thermosensitive metal layer, that is, there is a movable space for the deformation of the second movable portion 42' above the upper surface of the third thermosensitive metal layer. The fourth thermosensitive metal layer is arranged facing the guide conducting member 31. The composition of the second movable portion 42' is the same as or similar to the first movable portion 42 mentioned above, and will not be repeated herein.

Third Embodiment

As shown in FIG. 20 to FIG. 26, an atomizing device of the present invention includes an oil storage bin 1*a*, an atomizing mounting assembly 2*a*, a heating atomizing assembly 3*a*, and a liquid intake adjusting member 4*a*.

The oil storage bin 1*a* is provided therein with an air guide channel, and an oil storage cavity 11*a* configured for storing an atomizable liquid. The heating atomizing assembly 3*a* is disposed in the atomizing mounting assembly 2*a* and accommodated in the oil storage bin 1*a*. A liquid guide channel is provided between the heating atomizing assembly 3*a* and the oil storage cavity 11*a*.

The liquid intake adjusting member 4*a* is disposed at a position in the liquid guide channel close to the heating atomizing assembly 3*a*. The liquid intake adjusting member 4*a* is a thermosensitive metal sheet, which senses the temperature change of the heating atomizing assembly 3*a* and produces deformation, so as to automatically adjust the liquid inlet amount, and mainly to adjust the size of the liquid inlet space of the liquid guide channel to control the liquid inlet amount.

In this embodiment, the oil storage bin 1*a* is made of a hard insulating material, such as phenolic plastic, polyurethane plastic, epoxy plastic, unsaturated polyester plastic, furan plastic, silicone resin, acrylic resin, or the like, and their modified resins. The oil storage bin 1*a* is generally an elongated structure extending in the direction of a central axis, that is, the length of the oil storage bin 1*a* along the central axis is far larger than the width and the thickness, in two perpendicular directions, in a cross section of the oil storage bin 1*a*. The upper end of the oil storage bin 1*a* is provided with an air outlet 12*a*, and the periphery of the air outlet 12*a* extends downward to form an air duct 13*a*. The air outlet 12*a* and the air duct 13*a* cooperate to form the air guide channel. The lower end of the oil storage bin 1*a* is open, and the oil storage cavity 11*a* configured for storing the atomizable liquid is formed in the oil storage bin 1*a*. The air duct 13*a* is made of a metal material, such as stainless steel or the like, and is a hollow circular duct structure. Of course, the air duct 13*a* may also be made of a high-molecular polymer with a good stability, and the material, shape and size of the air duct 13*a* may be selected and designed according to requirements, which are not specifically limited herein.

In this embodiment, the atomizing mounting assembly 2*a* includes a foundation base 21*a*, a rubber base 22*a* arranged on the foundation base 21*a*, and a mounting tube 23*a* arranged on the rubber base 22*a*.

The heating atomizing assembly 3*a* includes a liquid guide tube 31*a* and a heating member 32*a*. The heating member 32*a* includes a spiral heating portion 311*a* arranged in the liquid guide tube 31*a* and a conductive portion 312*a* connected with the spiral heating portion 311*a*.

The liquid guide tube 31*a* is arranged in the mounting tube 23*a*, and the conductive portion 312*a* extends out of the mounting tube 23*a* and is mounted to the lower portion of the rubber base 22*a*.

The mounting tube 23*a* is provided with a liquid inlet hole 231*a* communicating the liquid guide tube 31*a* with the oil storage cavity 11*a*. The liquid guide channel is formed between the liquid inlet hole 231*a* and the oil storage cavity 11*a*, and the liquid intake adjusting member 4*a* is sleeved on the outer periphery of the mounting tube 23*a* and can cover the liquid inlet hole 231*a*. A plurality of liquid inlet holes 231*a* may be provided, for example, two axisymmetrically liquid inlet holes 231*a* may be provided.

Furthermore, the atomizing mounting assembly 2*a* further includes a columnar-shaped sealing member 24*a*, the sealing member 24*a* is provided with a through groove 241*a*, and the bottom portion of the air duct 13*a* is mounted in the through groove 241*a*. The sealing member 24*a* is further provided with a first clamping slot 242*a* with an opening downward, and the first clamping slot 242*a* may be an annular structure, or may be a plurality of slot structures arranged at intervals.

The rubber base 22*a* is provided with a concave positioning groove 2211*a*, and the positioning groove 2211*a* is provided with a second clamping slot 2212*a* therein. In this embodiment, the rubber base 22*a* includes a main body 221*a*, and the main body 221*a* extends downward to form a positioning portion 222*a*. The center position of the main body 221*a* is provided with a positioning groove 2211*a*, and the inner wall of the positioning groove 2211*a* is provided with the second clamping slot 2212*a*. The upper end of the mounting tube 23*a* is clamped in the first clamping slot 242*a*, and the lower end of the mounting tube 23*a* is clamped in the second clamping slot 2212*a*. Preferably, a through cavity is further provided in the positioning groove 2211*a* for the conductive portion 312*a* to be penetrated therein.

Preferably, the positioning groove 2211*a* includes a first section and a second section which are communicated with each other. The inner diameter of the first section is larger than the inner diameter of the second section. The connecting position between the first section and the second section forms a support step. The upper end of the liquid guide tube 31*a* abuts against the lower end of the sealing member 24*a*, and the lower end of the liquid guide tube 31*a* abuts against the upper surface of the support step. The liquid inlet hole 231*a* is located above the rubber base 22*a*.

Preferably, the foundation base 21*a* includes a bottom wall 211*a* and an annular sidewall 212*a* arranged on the bottom wall 211*a*. The annular sidewall 212*a* is connected with the inner wall of the oil storage bin 1*a* in a snap-fit manner. The outer periphery of the annular sidewall 212*a* is provided with a snap portion 2121*a*. Correspondingly, the inner wall of the oil storage bin 1*a* adjacent to the opening is provided with a concave groove 14*a*, and the snap portion 2121*a* is snapped in the concave groove 14*a* to fix the foundation base 21*a*.

Furthermore, the bottom wall 211*a* of the foundation base 21*a* is provided with a second conductive column 25*a* electrically connected with the conductive portion 312*a*. Preferably, the bottom of the rubber base 22*a* is provided with a mounting hole, one end of the conductive portion 312*a* away from the spiral heating portion 311*a* is bent into the mounting hole, and electrically connected with the second conductive column 25*a*. Of course, it is also possible to adopt other electrode structures, such as a sheet-shaped electrode, instead of the conductive column structure, which are not specifically limited herein. Preferably, the bottom wall 211*a* of the foundation base 21*a* is further provided with an air inlet through hole 2111*a*. Two air inlet through holes 2111*a* that are symmetrically arranged may be provided, and may be provided with an air guide cylinder structure.

In this embodiment, the liquid intake adjusting member 4*a* is a tubular structure, and includes a tubular body 41*a* and an adjusting portion 42*a* connected with the tubular body 41*a*. The tubular body 41*a* is sleeved on the atomizing mounting assembly 3*a*. The adjusting portion 42*a* extends out of the tubular body 41*a* to block the liquid guide channel, which may be formed by extending the tubular body 41*a* upwardly or downwardly. Of course, it may also be that the tubular body 41*a* is provided with an installation space (such as a through groove or the like), and the adjusting portion 42*a* is movably arranged in the installation space. Of course, the tubular body 41*a* may also be a bracket, an annular structure or a buckle structure, which is not specifically limited herein.

The heating atomizing assembly 3*a* generates heat during operation, which causes the adjusting portion 42*a* to deform, thus automatically adjusting the magnitude of the liquid intake amount.

Furthermore, the adjusting portion 42*a* includes a first surface and a second surface that are opposite each other. The thermal expansion coefficient of the first surface of the adjusting portion 42*a* is larger than the thermal expansion coefficient of the second surface of the adjusting portion. There is no shielding above the first surface of the adjusting portion 42*a*, and/or there is no shielding above the second surface of the adjusting portion 42*a*.

Figure 25:
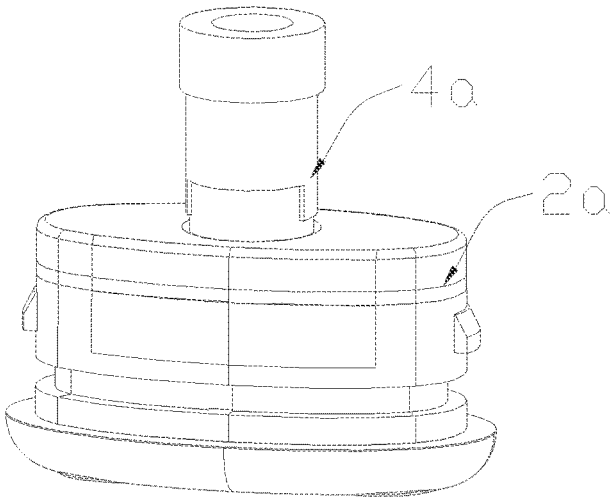
FIG. 25 is a structural diagram showing the liquid intake adjusting member (in the closed state) in FIG. 20 placed in an atomizing mounting assembly.
Figure 26:
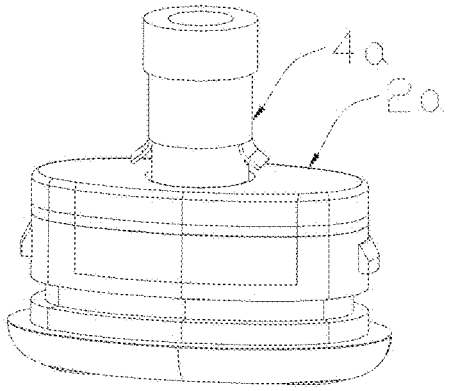
FIG. 26 is a structural diagram showing the liquid intake adjusting member (in the open state) in FIG. 20 placed in the atomizing mounting assembly.

Specifically, as shown in FIG. 25 to FIG. 26, the liquid intake adjusting member 4*a* may include a tubular body 41*a* and an adjusting portion 42*a* connected with the tubular body 41*a*, and the adjusting portion 42*a* is a plate structure or a sheet structure.

Furthermore, the adjusting portion 42*a* may be a thermosensitive metal sheet. The thermosensitive metal sheet is a composite member composed of two or more metals or other materials having appropriate properties. Wherein, the one with a relatively high thermal expansion coefficient is referred to as an active layer, and the one with a relatively low thermal expansion coefficient is referred to as a passive layer. The active layer is mainly made of manganese nickel copper alloy, nickel chromium iron alloy, nickel manganese iron alloy, nickel, or the like. The passive layer is mainly made of nickel iron alloy, and the nickel content is generally 34% to 50%. Due to the difference in the thermal expansion coefficients of the metals, when the temperature changes, the deformation of the active layer is larger than that of the passive layer, so that the thermosensitive metal sheet will be bent and deformed.

The adjusting portion 42*a* includes a fifth thermosensitive metal layer and a sixth thermosensitive metal layer. The lower surface of the fifth thermosensitive metal layer is attached to the upper surface of the sixth thermosensitive metal layer (wherein the upper surface refers to the surface away from the mounting tube 23*a*). The thermal expansion coefficient of the fifth thermosensitive metal layer is less than the thermal expansion coefficient of the sixth thermosensitive metal layer, that is, the fifth thermosensitive metal layer is the passive layer, and the sixth thermosensitive metal layer is the active layer. The sixth thermosensitive metal layer is arranged facing one side of the heating atomizing assembly 3*a*. The side of the fifth thermosensitive metal layer away from the heating atomizing assembly 3*a* is not shielded, that is, a movable space for the deformation of the adjusting portion 42*a* is reserved.

When the heating atomizing assembly 3*a* is not heating, the adjusting portion 42*a* covers the liquid inlet hole 231*a* to partition the liquid guide tube 31*a* from the liquid guide channel. When the heating atomizing assembly 3*a* is working, the adjusting portion deforms to the side away from the liquid guide tube 31*a* when heated, making the liquid guide space communicating the liquid guide tube 31*a* and the liquid guide channel increase (that is, gradually increase to the liquid guide space E), so that the atomizable liquid entering the liquid guide tube 31*a* increases.

Fourth Embodiment

Figure 27:
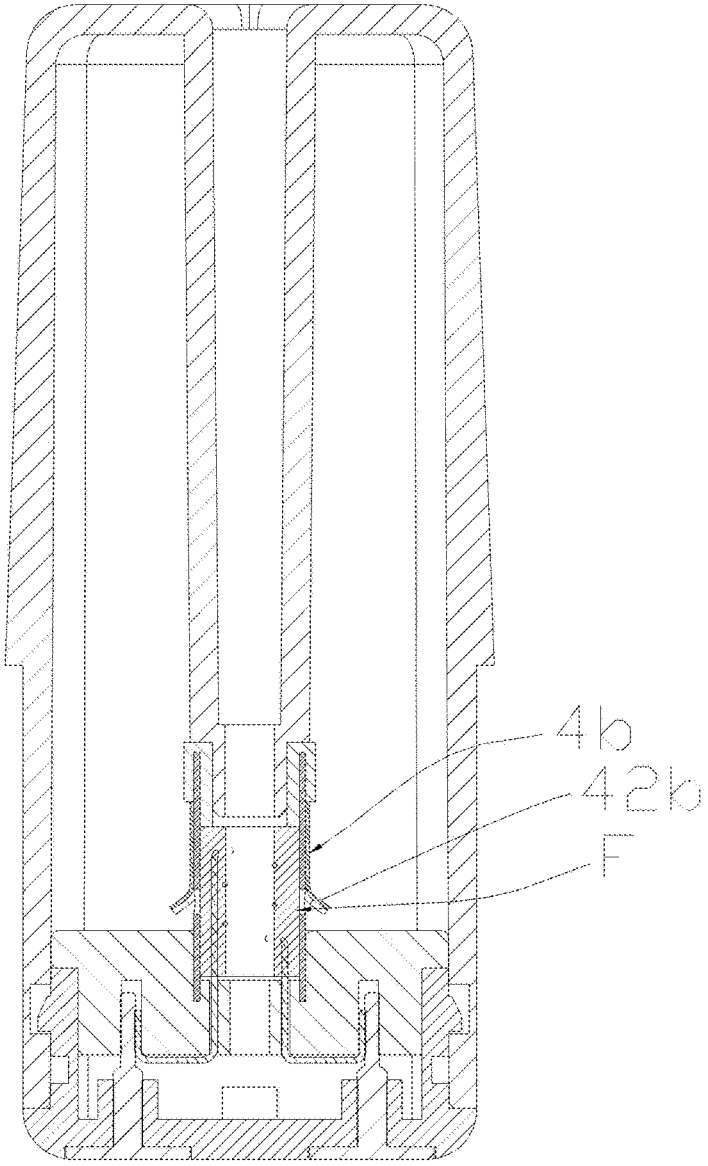
FIG. 27 is a sectional view of an atomizing device, wherein a liquid intake adjusting member is in an open state at a room temperature, in another embodiment of the present invention.
Figure 28:
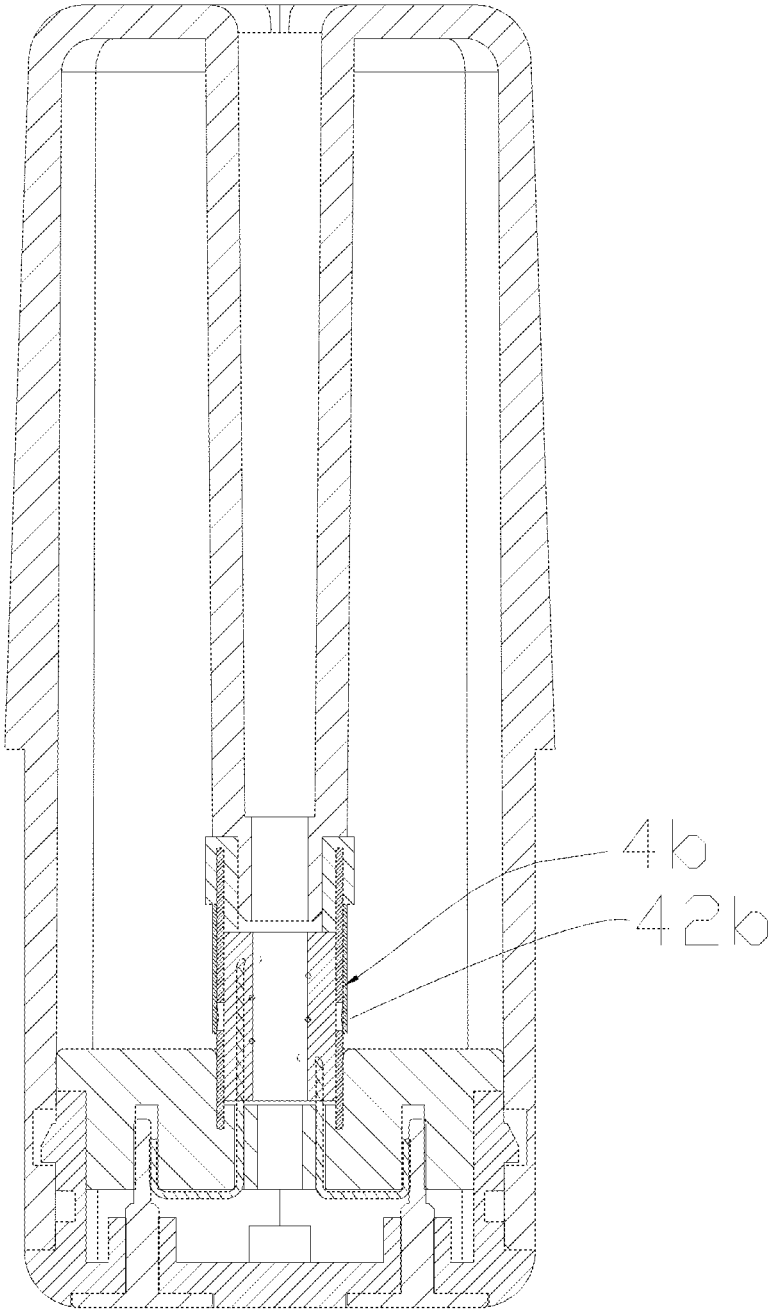
FIG. 28 is a sectional view of the atomizing device, wherein the liquid intake adjusting member is in a closed state, in another embodiment of the present invention.

The difference between this embodiment and the third embodiment lies in the structural composition of the adjusting portion. As shown in FIG. 27 to FIG. 28, in this embodiment, the adjusting portion 42*b* of the liquid intake adjusting member 4*b* is a thermosensitive metal sheet. The thermosensitive metal sheet is a composite member composed of two or more metals or other materials having appropriate properties. Wherein, the one with a relatively high thermal expansion coefficient is referred to as an active layer, and the one with a relatively low thermal expansion coefficient is referred to as a passive layer. The active layer is mainly made of manganese nickel copper alloy, nickel chromium iron alloy, nickel manganese iron alloy, nickel, or the like. The passive layer is mainly made of nickel iron alloy, with the nickel content generally at 34% to 50%. Due to the difference in the thermal expansion coefficients of the metals, the deformation of the active layer is larger than that of the passive layer when the temperature changes, so that the thermosensitive metal sheet will be bent and deformed.

Preferably, the adjusting portion 42*b* includes a seventh thermosensitive metal layer and an eighth thermosensitive metal layer. The lower surface of the seventh thermosensitive metal layer is attached to the upper surface of the eighth thermosensitive metal layer, the thermal expansion coefficient of the seventh thermosensitive metal layer is larger than the thermal expansion coefficient of the eighth thermosensitive metal layer, and the eighth thermosensitive metal layer is arranged facing the heating atomizing assembly.

Wherein, when the heating atomizing assembly 3*a* is not heating, the adjusting portion 42*b* is away from the liquid guide tube 31*a*. When the heating atomizing assembly 3*a* is working, the adjusting portion 42*b* is heated and deformed towards the side of the liquid guide tube 31*a*, so that the liquid guide space communicating the liquid guide tube 31*a* with the liquid guide channel becomes smaller (the liquid guide space F gradually becomes smaller), and the atomizable liquid entering the liquid guide tube 31*a* decreases.

When the e-liquid (the atomizable liquid) is high in concentration and viscous, its flow rate is slow, and a large liquid inlet area (a large liquid guide space) is needed when the atomizing device initially works. While when the heating atomizing assembly starts to work, the heat of the heating portion thereof will be transferred to the liquid guide tube (or the liquid guide member, the porous ceramics, or the like) and the e-liquid. When the temperature rises, the viscosity of the e-liquid is reduced so as to accelerate the flow rate, thereby easily causing the liquid to seep out of the liquid guide tube (or the liquid guide member, the porous ceramics, or the like). By adopting the above structure of the adjusting portion 42*b*, when the liquid is relatively viscous, the liquid inlet area (or the liquid guide space) of the heating atomizing assembly is relatively large, so as to ensure that the liquid can reach the heating portion smoothly; while when the heating portion starts to work, the temperature rises, the viscosity of the e-liquid decreases, the flow rate of the liquid becomes faster, the adjusting portion 42*b* senses the heat and generates deformation to block the liquid inlet hole, so as to reduce the liquid inlet area and control the contact area between the liquid and the liquid guide tube or the porous ceramics, so as to achieve the effect of no oil leakage.

The present invention further discloses an aerosol generating device, including an atomizing device and a power supply assembly configured to provide an electric energy for the atomizing device. Wherein, the atomizing device is the atomizing device in the first embodiment, the second embodiment, the third embodiment or the fourth embodiment.

The foregoing embodiments only show exemplary implementations of the present invention, and cannot be understood as a limitation to the patent scope of the present invention. It should be noted that a person of ordinary skill in the art may combine the foregoing technical features randomly and further make several variations and improvements without departing from the idea of this application. Therefore, all equivalent changes and modifications made according to the scope of the claims of the present invention shall fall within the scope of the claims of the present invention.

What is claimed is:

1. An atomizing device with liquid intake adjusting member, comprising:

an oil storage bin;

an atomizing mounting assembly;

a heating atomizing assembly; and the liquid intake adjusting member, wherein the oil storage bin is internally provided with an air guide channel, and an oil storage cavity configured for storing an atomizable liquid, wherein the heating atomizing assembly is disposed in the atomizing mounting assembly and accommodated in the oil storage bin, wherein a liquid guide channel is provided between the heating atomizing assembly and the oil storage cavity, wherein the liquid intake adjusting member is arranged adjacent to or arranged on the heating atomizing assembly, wherein the liquid intake adjusting member is a thermosensitive metal sheet, and configured to deform upon sensing a temperature change of the heating atomizing assembly, so as to automatically adjust the magnitude of a liquid intake amount, and wherein the liquid intake adjusting member comprises a first fixing portion and a first movable portion, the first fixing portion is a rectangular plate structure, and is provided with a mounting groove running through its upper and lower surfaces; a first end of the first movable portion is connected to a circumferential inner wall of the mounting groove, and a predetermined gap is reserved between a circumferential side surface of the first movable portion except the first end and the circumferential inner wall of the mounting groove.

2. The atomizing device with liquid intake adjusting member of claim 1, wherein the atomizing mounting assembly comprises a base, and a mounting seat arranged on the base and snap-engageable with the base, wherein the heating atomizing assembly is clamped between the mounting seat and the base, wherein the mounting seat comprises a main body and an embedding portion extending downwards from the main body, wherein the main body is provided with a liquid inlet groove communicating the oil storage cavity with the heating atomizing assembly, and wherein the liquid intake adjusting member is clamped or fixed between a bottom of the liquid inlet groove and the heating atomizing assembly.

3. The atomizing device with liquid intake adjusting member of claim 2, wherein the heating atomizing assembly comprises a liquid guide member and a heating member, wherein a surface of the liquid guide member facing the liquid guide channel is a liquid inlet surface, and a surface of the liquid guide member opposite the liquid inlet surface is an atomizing surface, wherein an atomizing cavity is formed between the atomizing surface and the base, wherein the heating member is arranged on the atomizing surface, and wherein the liquid intake adjusting member is arranged adjacent to the liquid inlet surface, or, the liquid intake adjusting member is arranged on an upper surface of the liquid inlet surface.

4. The atomizing device with liquid intake adjusting member of claim 1, wherein the atomizing mounting assembly further comprises a sealing sleeve that is sleeved on at least part of an outer periphery of the liquid guide member and disposed on an inner periphery of the embedding portion, wherein a central portion of the sealing sleeve is provided with a through hole penetrating through an upper surface and a lower surface thereof, wherein the through hole and the liquid inlet groove cooperate to form the liquid guide channel, and wherein the fixing portion is clamped or fixed between the interior of the sealing sleeve and the liquid inlet surface.

5. The atomizing device with liquid intake adjusting member of claim 4, wherein the atomizing mounting assembly further comprises a second sleeve sleeved on an outer periphery of the main body, wherein the second sleeve comprises a top wall, and a pair of retaining walls that extend downwards from a periphery of the top wall and are arranged oppositely, wherein outer peripheries of the retaining walls abut against an inner wall of the oil storage bin, wherein the top wall is provided with a liquid through hole penetrating through an upper surface and a lower surface thereof, and wherein the liquid through hole is disposed corresponding to the liquid inlet groove.

6. The atomizing device with liquid intake adjusting member of claim 5, wherein the base comprises a bottom plate, the bottom plate extends upward to form an annular support portion, and the annular support portion extends upward to form support arms opposite to each other, wherein the support arms are connected with the embedding portion in a snap-fit manner, wherein outer peripheries of the support arms are connected with an inner wall of the oil storage bin in a snap-fit manner, and wherein the bottom plate is further provided with a first conductive column electrically connected with the heating atomizing assembly, and an air inlet hole.

7. An aerosol generating device, comprising:

the atomizing device of claim 1; and a power supply assembly configured to supply power to the atomizing device.

8. The atomizing device with liquid intake adjusting member of claim 3, wherein in a working state of the heating atomizing assembly, the first movable portion is heated and deforms to a side away from the liquid guide member, which increases a liquid inlet space of the mounting groove and thus increases the amount of the atomizable liquid entering the liquid guide member.

* * * * *